United States Patent [19]

Baginski et al.

[11] 4,133,614

[45] Jan. 9, 1979

[54] DAUBER AND METHOD OF ASSEMBLY

[75] Inventors: John R. Baginski; William H. Goodpastor, both of Cincinnati, Ohio

[73] Assignee: The Procter & Gamble Company, Cincinnati, Ohio

[21] Appl. No.: 708,144

[22] Filed: Jul. 23, 1976

[51] Int. Cl.[2] ..... B43K 5/00; B43M 11/06

[52] U.S. Cl. ..... 401/206; 24/245 A; 29/448; 29/511; 29/525

[58] Field of Search ..... 401/206, 205, 207, 278, 401/202-204, 196; 24/92, 113 R, 245 R, 245 L, 245 F, 245 A

[56] References Cited

U.S. PATENT DOCUMENTS

| | | | |
|---|---|---|---|
| 1,071,964 | 9/1913 | Smith | 401/206 |
| 1,828,041 | 10/1931 | Hamacher | 24/245 R |
| 3,046,593 | 7/1962 | Goldman et al. | 401/202 |
| 3,121,429 | 2/1964 | Costa | 401/206 |
| 3,129,452 | 4/1964 | Schwartzman | 401/206 |
| 3,422,504 | 1/1969 | Brown | 24/245 A |
| 3,601,287 | 8/1971 | Schwartzman | 401/206 |
| 3,617,139 | 11/1971 | Ross | 401/206 |

*Primary Examiner*—Stephen C. Pellegrino
*Attorney, Agent, or Firm*—Thomas J. Slone; John V. Gorman; Richard C. Witte

[57] ABSTRACT

An improved dauber having a applicator pad which may have its central portion radially tensioned or which pad may have a predetermined degree of looseness. The improved dauber comprises a discrete retaining ring which is forced into a U-shape channel of the dauber along with the peripheral portion of the pad so that the peripheral portion of the pad is secured intermediate at least a portion of the retaining ring and an adjacent portion of the wall of the U-shape channel. Also, the peripheral portion of the pad may be partially wrapped about the retaining ring to provide more resistance to being loosened by rubbing. The retaining ring may comprise shaped portions such as serrations, teeth, hooks, or points which engage the peripheral portion of the pad during assembly of the dauber so that the central portion of the pad may become radially tensioned. The retaining ring and the peripheral portion of the pad are locked in the U-shape channel by substantially closing the channel.

4 Claims, 8 Drawing Figures

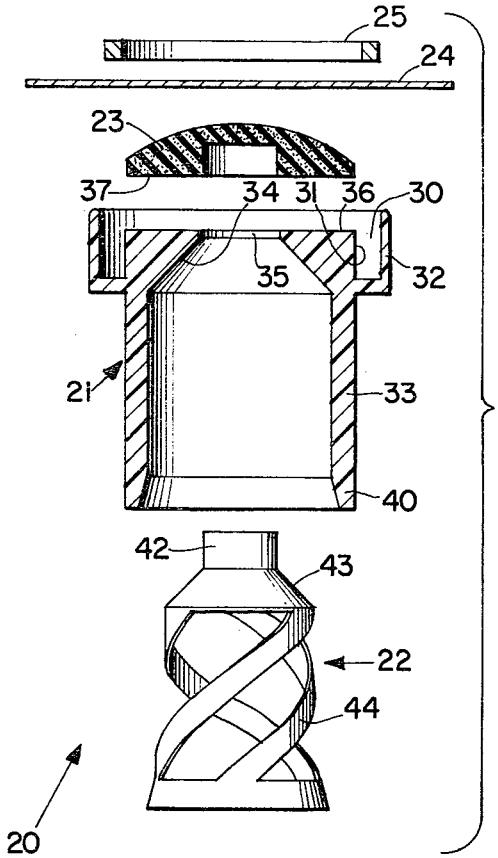
Fig. 1
Fig. 2
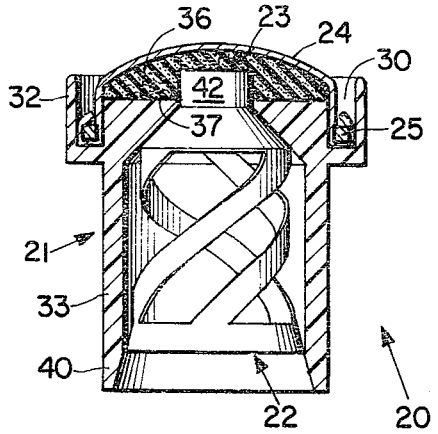
Fig. 3
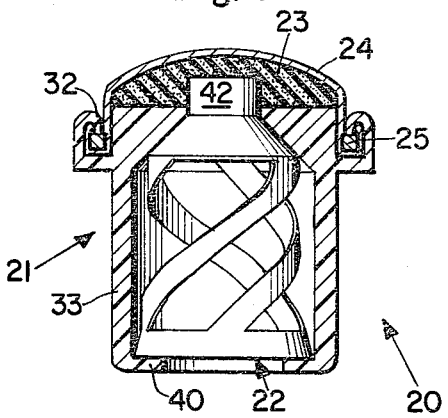
Fig. 4
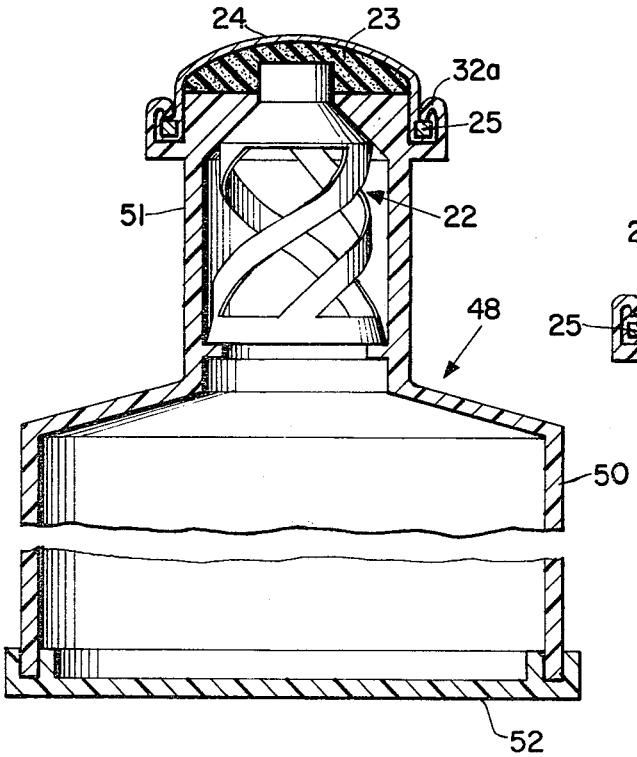
Fig. 5
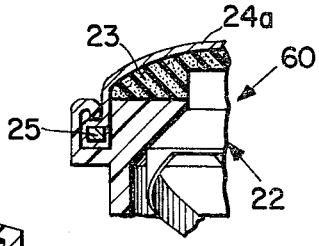
Fig. 6
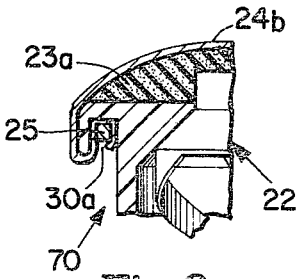
Fig. 7
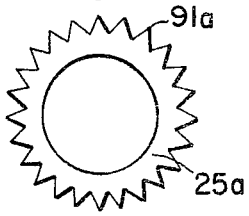
Fig. 8
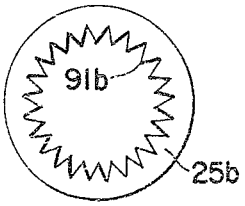

DAUBER AND METHOD OF ASSEMBLY

FIELD OF THE INVENTION

This invention generally relates to providing daubers for applying liquid products to surface areas of such things as articles of wearing apparel and the body by rubbing a porous applicator pad of the dauber on such surface areas. Such products may include but are not limited to medicaments, cleaning fluids, pre-wash laundry products polishes, inks, paints, insecticides, perfumes, and antiperspirants. More specifically, the present invention relates to providing a dauber having a porous pad secured thereto sufficiently well to substantially obviate loosening the pad when the dauber is vigorously rubbed as stated above. It is not intended, however, to preclude from the present invention non-fountain type daubers such as handled daubers for such uses as applying paste type shoe polish from a tin by dabbing the face of the dauber in the body of polish.

DESCRIPTION OF THE PRIOR ART

The prior art discloses prior art daubers wherein the peripheral portion of a porous applicator pad is secured in a U-shape channel which channel is provided in the body of the dauber, or in a fitment which is adapted to fit a dauber body or other product container. For instance, U.S. Pat. No. 3,264,676 which issued Aug. 9, 1966 to Gilbert Schwartzman discloses a Spin Welded Package wherein the peripheral portion of a "clover 20" is secured in a U-shape channel disposed in the top end of the container cylinder 12, and U.S. Pat. No. 3,129,452 which issued Apr. 21, 1964 to Gilbert Schwartzman discloses a dauber fitment wherein the peripheral portion of a "cover 20" is secured in a U-shape channel disposed in the top end of the fitment. As used herein, the term dauber is generally used in the generic sense to include the term dauber fitments. None of the referenced prior art has, however, solved to the extent of the present invention the problem of having a dauber cover or pad invertently become loose or separated from the dauber when subjected to rubbing forces; that is the problem of having the pad loosened by transverse forces induced in the cover or pad when the dauber is rubbed on a surface to, for instance, apply product from within the dauber to the surface through the cover or pad.

SUMMARY OF THE INVENTION

The nature and substance of the present invention will be more readily appreciated after giving consideration to its major aims and purposes. The principal objects of the present invention are recited in the ensuing paragraphs in order to provide a better appreciation of its important aspects prior to describing the details of a preferred embodiment and other embodiments in later portions of this description.

A major object of the present invention is to provide a dauber or liquid applicator wherein an applicator pad is so secured that it robustly resists being loosened or separated by rubbing induced forces.

Another object of the present invention is to provide a dauber having a radially tensioned porous pad which is restrained sufficiently about its perimeter to resist being loosened under the action of vigorous rubbing.

Yet another object of the present invention is to provide a method of assembling a dauber comprising a porous applicator pad so that the pad is radially tensioned and is restrained sufficiently about its perimeter that loosening of the pad under vigorous rubbing is substantially obviated.

Yet still another object of the present invention is to provide a dauber having a porous applicator pad which has a predetermined degree of looseness.

The above and other objects are achieved in accordance with one aspect of the present invention by providing a dauber comprising a container body or fitment having a U-shape annular channel disposed adjacent its top and defined in part between a first rim and a second rim. The dauber further comprises a porous applicator pad and a discrete retaining ring. The retaining ring and the peripheral portion of the pad are locked in contacting relation in the channel by deforming at least one of the rims to substantially close the channel. The method may comprise the steps of positioning the pad so that its peripheral portion is disposed intermediate the channel and the retaining ring; then telescoping the ring into the channel so that the peripheral portion of the pad is drawn into the channel and is secured intermediate a portion of the retaining ring and an adjacent annular portion of the wall defining the U-shape channel; and then substantially closing the channel as by displacing at least a portion of one of the rims towards the other.

BRIEF DESCRIPTION OF THE DRAWINGS

While the specification concludes with claims particularly pointing out and distinctly claiming the subject matter regarded as forming the present invention, it is believed the invention will be better understood from the following description taken in connection with the accompanying drawings in which:

FIG. 1 is an exploded, partially sectioned elevational view of a dauber fitment embodiment of the present invention.

FIG. 2 is a partially sectioned elevational view of the dauber fitment of FIG. 1 after being partially assembled.

FIG. 3 is a partially sectioned elevational view of the dauber fitment of FIGS. 1 and 2 after being completely assembled.

FIG. 4 is a fragmentary, partially sectioned view of a dauber assembly embodying the present invention.

FIGS. 5 and 6 are fragmentary sectional views of alternate embodiments of the present invention.

FIGS. 7 and 8 are plan views of alternate embodiment retaining rings.

DESCRIPTION OF THE PREFERRED EMBODIMENT

A preferred embodiment dauber fitment 20 is shown in the exploded state in FIG. 1 to comprise a body 21, a valve member 22, a resilient porous element 23, a flexible porous applicator pad 24, and a retaining ring 25.

The body 21 comprises an upwardly facing annular channel 30 having a U-shape cross section defined between a first or inner annular-shape rim or wall 31 and a second or outer annular-shape rim or wall 32. The body 21 further comprises a downwardly depending tubular skirt 33 for sealingly adapting the dauber fitment to a container, a valve seat 34 adapted to cooperate with valve member 22 to normally sealingly close the central passageway 35, and means such as an annular surface 36 for accomodating the base 37 of the resilient porous element 23.

The body 21 of the preferred embodiment dauber fitment 20 is preferably made from thermoplastic material such as polyethylene or polypropylene but it is not intended to thereby limit the present invention. However, embodiments of the present invention exhibit substantially increased resistance to pad loosening as compared to similar daubers which do not embody the present invention and which comprise low density thermoplastic materials having low yield strengths and low spring constants; properties which necessarily limit the clamping force (i.e.: pad retention force) that can be achieved between adjacent or abutting portions of a body such as adjacent annular rims.

The valve member 22, FIG. 1, comprises an actuator portion 42, a valve sealing surface 43, and an integral compression spring 44 which, when the fitment is assembled, FIG. 3, biases the valve member 22 to its closed position.

The resilient porous element 23 preferably comprises porous polyurethane foam and is provided essentially to give the top end of the dauber fitment 20 a predetermined shape and softness. The porous element 23 is also provided to distribute liquid product flowing through the valve passageway 35 to substantially the entire pad 24.

The porous applicator pad 24 preferably comprises a brushed nylon knitted fabric although some products may require pads of other materials to obviate chemically reacting with particular products and/or to provide sufficient abrasion resistance for particular uses.

The porous applicator pad 24 is preferably sufficiently large that its peripheral portion can be wrapped at least partially about the retaining ring 25 to insure that the peripheral portion is securely retained in the channel 30 of the body 21.

The retaining ring 25 preferably comprises a substantially rigid material, and has a rectangular cross-section and an annular shape. In the preferred embodiment, retaining ring 25 has an interference fit in channel 30 when in contacting relation with or at least partially wrapped by the peripheral portion of pad 24. Also the relative coefficient of friction between the retaining ring 25 and the pad 24 is preferably greater than the coefficient of friction between the pad 24 and the body 21 for a purpose hereinafter discussed.

The dauber fitment 20 is preferably assembled by placing the base 37 of resilient porous element 23 on surface 36 of body 21, placing the porous pad 24 so that its peripheral portion is adjacent the annular opening of the channel 30 in body 21, and by the telescoping the retaining ring 25 into channel 30 so that the peripheral portion of the porous pad 24 is forced into channel 30. This causes the retaining ring 25 and the peripheral portion of the pad to be in contacting relation in the channel 30 and, providing the peripheral portion of the pad is sufficiently large, it becomes at least partially wrapped about the retaining ring 25 as indicated in FIG. 2. It is believed this occurs because of the relative coefficients of friction described hereinabove. That is, the greater friction between the ring and the pad as compared to the friction between the pad and the body causes the pad to slip against the body or rim as the ring is telescoped into the channel 30. The assembly is completed, FIG. 3, by swaging, rolling, or thermoforming the outer rim 32 inwardly to substantially close channel 30 and to thereby lock the retaining ring 25 and the peripheral portion of pad 24 in channel 30, and by turning the distal end 40 of skirt 33 inwardly to lock the valve member 22 in body 21 as shown in FIG. 3.

The improved duaber fitment 20 is used in conventional ways. For instance, the skirt 33 of fitment 20 is sealingly fitted into the neck of a container (not shown) filled with a liquid product (not shown) to form a fountain-type liquid applicator comprising a dauber. Then, the liquid is dispensed and applied via the porous pad 24 by inverting the container and pressing inwardly on the pad 24 with sufficient force to press against the valve actuator portion 42 and thereby open the valve. Commonly, this is done by pressing the dauber against the surface on which the liquid product is to be applied. Upon cecessation of such pressing, the normally closed valve closes. That is surfaces 34 and 43 are biased together so that no liquid product can pass therebetween. A cap, not shown, can also be provided to substantially preclude product evaporation and/or drying of the pad 24.

FIG. 4 shows an alternate embodiment 48 of the present invention comprising a container 50 which has its neck 51 configured and adapted to serve the functions of the body 21 of the dauber fitment 20 described hereinbefore. That is, valve member 22 is placed inside the neck 51 as shown. The remainder of the assembly, that is associating and assembling the resilient porous element 23, the porous applicator pad 24, and the retaining ring 25, and the ultimate swaging or thermoforming are all done as described hereinabove with respect to dauber fitment 20. Of course, means such as a discrete container bottom 52 must be provided to enable placing the valve member 22 in the container 50 and then sealingly securing the bottom 52 to the container 50. Such a construction is shown in U.S. Pat. No. 3,264,676 which was referenced hereinbefore.

FIG. 5 shows an alternate embodiment, dauber 60, of the present invention wherein the peripheral portion of the porous applicator pad **24*a* is wrapped about the radially outwardly facing portion of the retaining ring 25 and then under and up along the radially inwardly facing surface of the retaining ring 25. Preferably, this embodiment is assembled by first wrapping the peripheral portion of the porous pad 24*a* about the retaining ring as stated above, and then forcing the wrapped retaining ring 25 into channel 30**.

FIG. 6 shows yet another embodiment, dauber 70, of the present invention wherein the U-shape channel **30*a* opens downwardly rather than upwardly. The assembly of dauber 70 would be substantially similar to that of dauber 20 although it is apparent that pad 24*b* would have to be larger than pad 24 of dauber 20**.

FIGS. 7 and 8 show alternate embodiment retaining rings **25*a* and 25*b* having, respectively, radially outwardly or radially inwardly extending projections such as serrations, teeth, hooks or points 91*a* or 91*b* respectively which are provided to mechanically engage portions of porous applicator pads during assembly to insure, for instance, that the peripheral portions of the pads are pulled into the channels and become at least partially wrapped about their associated retaining rings when assembled as indicated by the sequence of FIGS. 1 and 2**.

While it is believed that daubers and/or dauber fitments having radially tensioned porous applicator pads will generally provide better performance and have more consumer appeal than daubers having slack or loosely fitted porous applicator pads, a slack or loosely fitted pad embodiment (not shown) of the invention can be provided, for instance, by using an assembly fixture (not shown) to hold the body 21 and the resilient porous element 23 in spaced relation while the retaining ring 25 and the peripheral portion of the porous applicator pad 24 are forced into the channel 30 of the body 21; reference FIGS. 1 and 2. In this event, the degree of spacing would provide a predetermined degree of looseness. Of course, in this event it is believed it would be necessary to place valve member 22 in the body 21 after the pad 24 has been secured.

While several embodiments of the present invention have been illustrated and described, it is not intended to thereby limit the present invention; particularly not to fountain-type liquid applicators. Rather, it will be obvious to those skilled in the art that various changes and modifications can be made without departing from the spirit and scope of the invention. It is intended, therefore, to cover in the appended claims all such changes and modifications that are within the scope of this invention.

What is claimed is:

1. A method of assembling the applicator portion of a dauber comprising a porous pad, a discrete, substantially rigid and unsplit retaining ring, and a body having an annular inner rim having a right-cylindrical-shape outwardly facing surface, an annular outer rim having a right-cylindrical-shape inwardly facing surface and an upwardly open U-shape annular channel intermediate said right-cylindrical-shape surfaces, said rims and said channel being so sized with respect to said pad and said ring that the peripheral portion of said pad and said retaining ring have an interference fit in said channel when the peripheral portion of said pad is partially wrapped about said retaining ring and said retaining ring is disposed in said channel, said pad being retained in said applicator when assembled by the method which comprises the steps of:

positioning said pad with respect to said channel so that the peripheral portion of said pad is disposed superjacent said channel;

placing said retaining ring superjacent said peripheral portion of said pad so that said peripheral portion of said pad is intermediate said ring and said channel; and telescoping said retaining ring into said channel so that said peripheral portion of said pad is concurrently pulled into said channel and said peripheral portion of said pad becomes substantially wrapped into an upwardly open U-shape annulus about said retaining ring.

2. A method of assembling the applicator portion of a dauber comprising a porous pad, a discrete, substantially rigid and unsplit retaining ring, a body having an inner rim, an outer rim and an upwardly opening U-shape annular channel intermediate said rims, said rims and said channel being so sized with respect to said pad and said ring that said pad will be retained by an interference fit when assembled by the method which comprises the steps of:

positioning said pad with respect to said channel so that the peripheral portion of said pad is disposed adjacent said channel;

placing said retaining ring adjacent said peripheral portion of said pad so that said peripheral portion of said pad is intermediate said ring and said channel;

telescoping said retaining ring into said channel to cause said peripheral portion of said pad to be pulled into said channel and to become wrapped into an upwardly open U-shape annulus about said retaining ring and secured by an interference fit intermediate said retaining ring and the adjacent walls of the U-shape channel; and, locking the retaining ring and the peripheral portion of the porous pad within the channel by displacing at least one said rim towards the other to substantially close said channel.

3. An improved dauber having a body and a porous pad wherein the peripheral portion of the pad is swaged into an upwardly open U-shape annular channel, said improvement comprising the addition of a discrete, substantially rigid and unsplit retaining ring disposed in said channel and having said peripheral portion of said pad formed into an upwardly open U-shape annulus about said discrete retaining ring, said pad, retaining ring, and said channel being so relatively sized and configured to provide means for securing said pad sufficiently tightly by an interference fit that loosening of the pad under the action of vigorous rubbing is virtually obviated.

4. The improved dauber of claim 3 wherein the porous pad is radially tensioned a predetermined amount.

* * * * *